US006764030B2

(12) United States Patent
Habib et al.

(10) Patent No.: US 6,764,030 B2
(45) Date of Patent: Jul. 20, 2004

(54) SOOTBLOWER NOZZLE ASSEMBLY WITH AN IMPROVED DOWNSTREAM NOZZLE

(75) Inventors: Tony F. Habib, Lancaster, OH (US); David L. Keller, Grandville, OH (US)

(73) Assignee: Diamond Power International, Inc., Lancaster, OH (US)

( * ) Notice: Subject to any disclaimer, the term of this patent is extended or adjusted under 35 U.S.C. 154(b) by 258 days.

(21) Appl. No.: 10/039,430

(22) Filed: Jan. 2, 2002

(65) Prior Publication Data

US 2002/0121563 A1 Sep. 5, 2002

Related U.S. Application Data

(60) Provisional application No. 60/261,542, filed on Jan. 12, 2001.

(51) Int. Cl.[7] ..... B05B 1/20

(52) U.S. Cl. ..... 239/566; 239/461; 239/750; 239/752; 239/589; 239/DIG. 13; 122/379; 122/390; 15/316.1

(58) Field of Search ..... 239/461, 566, 239/567, 589, 750, 752, 753, DIG. 13; 15/316.1, 317; 122/390, 392, 379

(56) References Cited

U.S. PATENT DOCUMENTS

| | | | | |
|---|---|---|---|---|
| 1,762,313 A | | 6/1930 | Snow et al. | |
| 1,809,221 A | | 6/1931 | Snow et al. | |
| 1,847,447 A | | 3/1932 | Snow et al. | |
| 1,847,448 A | | 3/1932 | Snow et al. | |
| 1,848,807 A | | 3/1932 | Snow et al. | |
| 1,848,885 A | | 3/1932 | Howse et al. | |
| 2,897,532 A | | 8/1959 | Cantieri | |
| 2,904,260 A | | 9/1959 | Schueler et al. | |
| 2,933,259 A | | 4/1960 | Raskin | |
| 3,068,507 A | | 12/1962 | Evans | |
| 4,218,016 A | * | 8/1980 | Freund | 239/DIG. 13 |
| 4,359,800 A | | 11/1982 | Ziels | |
| 4,503,811 A | * | 3/1985 | Hammond | 122/392 |

(List continued on next page.)

FOREIGN PATENT DOCUMENTS

| | | |
|---|---|---|
| BE | 669895 | 1/1966 |
| DD | 137814 | 9/1979 |
| DE | 94 18 733.9 | * 2/1995 |
| GB | 170991 | 11/1921 |
| GB | 242818 | 11/1925 |
| JP | 57-157927 | 9/1982 |
| SE | 116130 | 4/1946 |
| WO | WO 97/38264 | * 10/1997 |

OTHER PUBLICATIONS

Internal Corporate Document Describing Prior Art Nozzle Designs.

*Primary Examiner*—Steven J. Ganey
(74) *Attorney, Agent, or Firm*—Brinks Hofer Gilson & Lione

(57) ABSTRACT

The present invention discloses a new design of the nozzle and the lance tube of a sootblower to clean the interior of a heat exchanger by impingement of a jet of cleaning medium. In accordance with the teachings of the present invention the sootblower design developed, incorporates a nozzle at the tip of the distal end of the lance tube (downstream nozzle). The lance tube also includes an upstream nozzle positioned opposite and longitudinally apart the distal end nozzle. This design allows for the flow of the cleaning medium to enter into the inlet end of the nozzle without coming to a halt at the end of the lance tube. Further, the present invention also provides for a converging channel to be disposed in the interior of the lance tube to direct the flow of cleaning medium passing the upstream nozzle into the inlet end of the downstream nozzle with minimal hydraulic losses and flow maldistribution. The present invention also discloses an airfoil body to be placed around the upstream nozzle to minimize the flow disturbances caused by the bluff body of the converging channel.

64 Claims, 13 Drawing Sheets

U.S. PATENT DOCUMENTS 4,567,622 A 2/1986 Ziels
4,773,357 A 9/1988 Scharton et al.
5,063,632 A 11/1991 Clark et al.
5,230,306 A 7/1993 Barringer et al.
5,241,723 A 9/1993 Garrabrant
5,271,356 A 12/1993 Kling et al.
5,277,153 A 1/1994 Kakabaker
5,375,771 A 12/1994 Jameel et al.
5,379,727 A 1/1995 Kling et al.
5,423,483 A * 6/1995 Schwade
5,505,163 A 4/1996 Jameel
5,509,607 A * 4/1996 Booher et al. ..... 15/316.1
5,667,139 A 9/1997 Dickie
5,778,831 A 7/1998 Jameel
5,794,857 A 8/1998 Chen et al.

* cited by examiner

SOOTBLOWER NOZZLE ASSEMBLY WITH AN IMPROVED DOWNSTREAM NOZZLE

CROSS REFERENCE TO RELATED APPLICATION

This specification claims priority to U.S. Provisional Patent Application No. 60/261,542, filed on Jan. 12, 2001, entitled "Sootblower Nozzle Assembly With an Improved Downstream Nozzle".

TECHNICAL FIELD OF THE INVENTION

This invention generally relates to a sootblower device for cleaning interior surfaces of large-scale combustion devices. More specifically, this invention relates to new designs of nozzles for a sootblower lance tube providing enhanced cleaning performance.

BACKGROUND OF THE INVENTION

Sootblowers are used to project a stream of a blowing medium, such as steam, air, or water against heat exchanger surfaces of large-scale combustion devices, such as utility boilers and process recovery boilers. In operation, combustion products cause slag and ash encrustation to build on heat transfer surfaces, degrading thermal performance of the system. Sootblowers are periodically operated to clean the surfaces to restore desired operational characteristics. Generally, sootblowers include a lance tube that is connected to a pressurized source of blowing medium. The sootblowers also include at least one nozzle from which the blowing medium is discharged in a stream or jet. In a retracting sootblower, the lance tube is periodically advanced into and retracted from the interior of the boiler as the blowing medium is discharged from the nozzles. In a stationary sootblower, the lance tube is fixed in position within the boiler but may be periodically rotated while the blowing medium is discharged from the nozzles. In either type, the impact of the discharged blowing medium with the deposits accumulated on the heat exchange surfaces dislodges the deposits. U.S. Patents which generally disclose sootblowers include the following, which are hereby incorporated by reference U.S. Pat. Nos. 3,439,376; 3,585,673; 3,782,336; and 4,422,882.

A typical sootblower lance tube comprises at least two nozzles that are typically diametrically oriented to discharge streams in directions 180° from one another. These nozzles may be directly opposing, i.e. at the same longitudinal position along the lance tube or are longitudinally separated from each other. In the latter case, the nozzle closer to the distal end of the lance tube is typically referred to as the downstream nozzle. The nozzle longitudinally furthest from the distal end is commonly referred to as the upstream nozzle. The nozzles are generally but not always oriented with their central passage perpendicular to and intersecting the longitudinal axis of the lance tube and are positioned near the distal end of the lance tube.

Various cleaning mediums are used in sootblowers. Steam and air are used in many applications. Cleaning of slag and ash encrustations within the internal surfaces of a combustion device occurs through a combination of mechanical and thermal shock caused by the impact of the cleaning medium. In order to maximize this effect, lance tubes and nozzles are designed to produce a coherent stream of cleaning medium having a high peak impact pressure on the surface being cleaned. Nozzle performance is generally quantified by measuring dynamic pressure impacting a surface located at the intersection of the centerline of the nozzle at a given distance from the nozzle. In order to maximize the cleaning effect, it is desired to have the stream of compressible blowing medium fully expanded as it exits the nozzle. Full expansion refers to a condition in which the static pressure of the stream exiting the nozzle approaches that of the ambient pressure within the boiler. The degree of expansion that a jet undergoes as it passes through the nozzle is dependent, in part, on the throat diameter (D) and the length of the expansion zone within the nozzle (L), commonly expressed as an L/D ratio. Within limits, a higher L/D ratio generally provides better performance of the nozzle.

Classical supersonic nozzle design theory for compressible fluids such as air or steam require that the nozzle have a minimum flow cross-sectional area often referred to as the throat, followed by an expanding cross-sectional area (expansion zone) which allows the pressure of the fluid to be reduced as it passes through the nozzle and accelerates the flow to velocities higher than the speed of sound. Various nozzle designs have been developed that optimize the L/D ratio to substantially expand the stream or jet, as it exits the nozzle. Constraining the practical lengths that sootblower nozzles can have is a requirement that the lance assembly must pass through a small opening in the exterior wall of the boiler, called a wall box. For long retracting sootblowers, the lance tubes typically have a diameter on the order of three to five inches. Nozzles for such lance tubes cannot extend a significant distance beyond the exterior cylindrical surface of the lance tube. In applications in which two nozzles are diametrically opposed, severe limitations in extending the length of the nozzles are imposed to avoid direct physical interference between the nozzles or an unacceptable restriction of fluid flow into the nozzle inlets occurs. In an effort to permit longer sootblower nozzles, nozzles of sootblower lance tubes are frequently longitudinally displaced. Although this configuration generally enhances performance by facilitating the use of nozzles having a more ideal L/D ratio, it has been found that the upstream nozzle exhibits significantly better performance than the downstream nozzle. Thus, an undesirable difference in cleaning effect results between the nozzles.

Initially, low performance of the downstream nozzle was attributed to the loss of static pressure associated with the fluid flow passing around the bluff body presented by the upstream nozzle in the form of the cylindrical projection of the nozzle into the lance tube interior. However, experiments conducted revealed that even when the upstream nozzle is moved radially outward to present no obstruction to the flow through the lance tube, the performance of the downstream nozzle did not significantly improve. The low performance of the downstream nozzle is believed to be due, in a significant manner, to the stagnation area created in the distal end of the conventional lance tube. A typical lance tube end or "nozzle block" has a rounded, hemispherical distal end surface. Since the downstream nozzle penetrates the nozzle block before the distal end hemispherical end surface, an internal volume exists beyond the downstream nozzle. Accordingly, a significant portion of the cleaning fluid approaching the downstream nozzle is forced to flow past the nozzle inlet and come to a stagnation condition at the distal end of the lance tube, and then re-accelerate to enter the nozzle. Furthermore, the back streams returning from the distal end are colliding with the forward streams at the downstream nozzle inlet leading to greater hydraulic losses and most importantly distorting the flow distribution into the nozzle. The hydraulic losses associated with the stagnation conditions at the distal end and at the nozzle inlet coupled with the flow mal-distribution which, based on concepts developed in connection with this invention, were believed, in large part, responsible for the low performance of the downstream nozzle. Therefore, there is a need in the art to provide a new lance tube design that will substantially increase the performance of the downstream nozzle.

SUMMARY OF THE INVENTION

In accordance with this invention, improvements in nozzle design are provided which provide enhanced performance of the downstream nozzle. In each case according to this invention, the nozzle block is formed to substantially eliminate the stagnation within the lance tube area beyond the downstream nozzle found in the prior art designs. Another beneficial feature of this invention involves streamlining at the upstream nozzle which minimizes the disruption to flow of cleaning medium to the downstream nozzle.

Briefly, a first embodiment of the present invention includes a downstream nozzle at the distal end of the lance tube with a converging channel formed in the interior of the lance tube to direct the flow of the cleaning medium passing the upstream nozzle and directing the flow to the downstream nozzle. The converging channel substantially eliminates the stagnation volume of the distal end of the conventional lance tube. This has the benefit of reducing hydraulic losses and improving the degree of uniformity of flow velocity at the throat, which in turn enhances the flow expansion and the conversion of static energy into kinetic energy.

The second embodiment of the present invention has an interior surface substantially identical to the first embodiment. However, the second embodiment nozzle block has a thin wall configuration which reduces the mass of the nozzle block.

A third embodiment of the present invention includes an airfoil body around the outside surface of the upstream nozzle. By providing streamline design of the outer surface of the upstream nozzle, the flow disturbances associated with the upstream nozzle is minimized.

A fourth embodiment of the invention features an upstream nozzle with its inlet end tipped toward the flow of the cleaning medium flowing through the lance tube.

In a fifth embodiment, the upstream nozzle features a longitudinal axis perpendicular to the longitudinal axis of the lance tube with the nozzle inlet tipped toward the flow of the blowing medium.

In a sixth embodiment in accordance with the teaching of the present invention provides for the design of the upstream nozzle having its outlet end flush with the body of the lance tube.

BRIEF DESCRIPTION OF THE DRAWINGS

Further features and advantages of the invention will become apparent from the following discussion and accompanying drawings, in which.

DETAILED DESCRIPTION OF THE INVENTION

The following description of the preferred embodiment is merely exemplary in nature, and is in no way intended to limit the invention or its application or uses.

Figure 1:
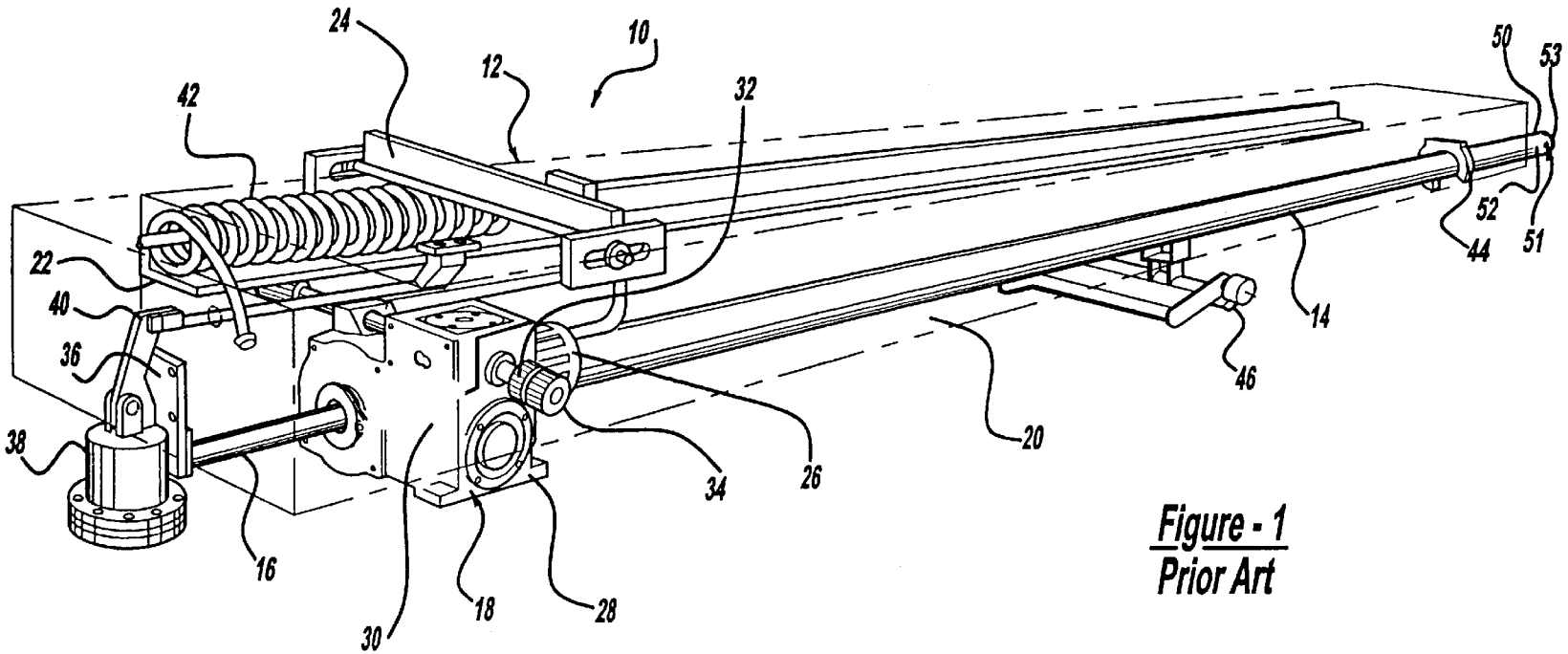
Figure - 1 Prior Art
FIG. 1 is a pictorial view of a long retracting sootblower which is one type of sootblower which may incorporate the nozzle assemblies of the present invention.

A representative sootblower, is shown in FIG. 1 and is generally designated there by reference number 10. Sootblower 10 principally comprises frame assembly 12, lance tube 14, feed tube 16, and carriage 18. Sootblower 10 is shown in its normal retracted resting position. Upon actuation, lance tube 14 is extended into and retracted from a combustion system such as a boiler (not shown) and may be simultaneously rotated.

Frame assembly 12 includes a generally rectangularly shaped frame box 20, which forms a housing for the entire unit. Carriage 18 is guided along two pairs of tracks located on opposite sides of frame box 20, including a pair of lower tracks (not shown) and upper tracks 22. A pair of toothed racks (not shown) are rigidly connected to upper tracks 22 and are provided to enable longitudinal movement of carriage 18. Frame assembly 12 is supported at a wall box (not shown) which is affixed to the boiler wall or another mounting structure and is further supported by rear support brackets 24.

Carriage 18 drives lance tube 14 into and out of the boiler and includes drive motor 26 and gear box 28 which is enclosed by housing 30. Carriage 18 drives a pair of pinion gears 32 which engage the toothed racks to advance the carriage and lance tube 14. Support rollers 34 engage the guide tracks to support carriage 18.

Feed tube 16 is attached at one end to rear bracket 36 and conducts the flow of cleaning medium which is controlled through the action of poppet valve 38. Poppet valve 38 is actuated through linkages 40 which are engaged by carriage 18 to begin cleaning medium discharge upon extension of lance tube 14, and cuts off the flow once the lance tube and carriage return to their idle retracted position, as shown in FIG. 1. Lance tube 14 over-fits feed tube 16 and a fluid seal between them is provided by packing (not shown). A soot-blowing medium such as air or steam flows inside of lance tube 14 and exits through one or more nozzles 50 mounted to nozzle block 52, which defines a distal end 51. The distal end 51 is closed by a semispherical wall 53.

Coiled electrical cable 42 conducts power to the drive motor 26. Front support bracket 44 supports lance tube 14 during its longitudinal and rotational motion. For long lance tube lengths, an intermediate support 46 may be provided to prevent excessive bending deflection of the lance tube.

Figure 2:
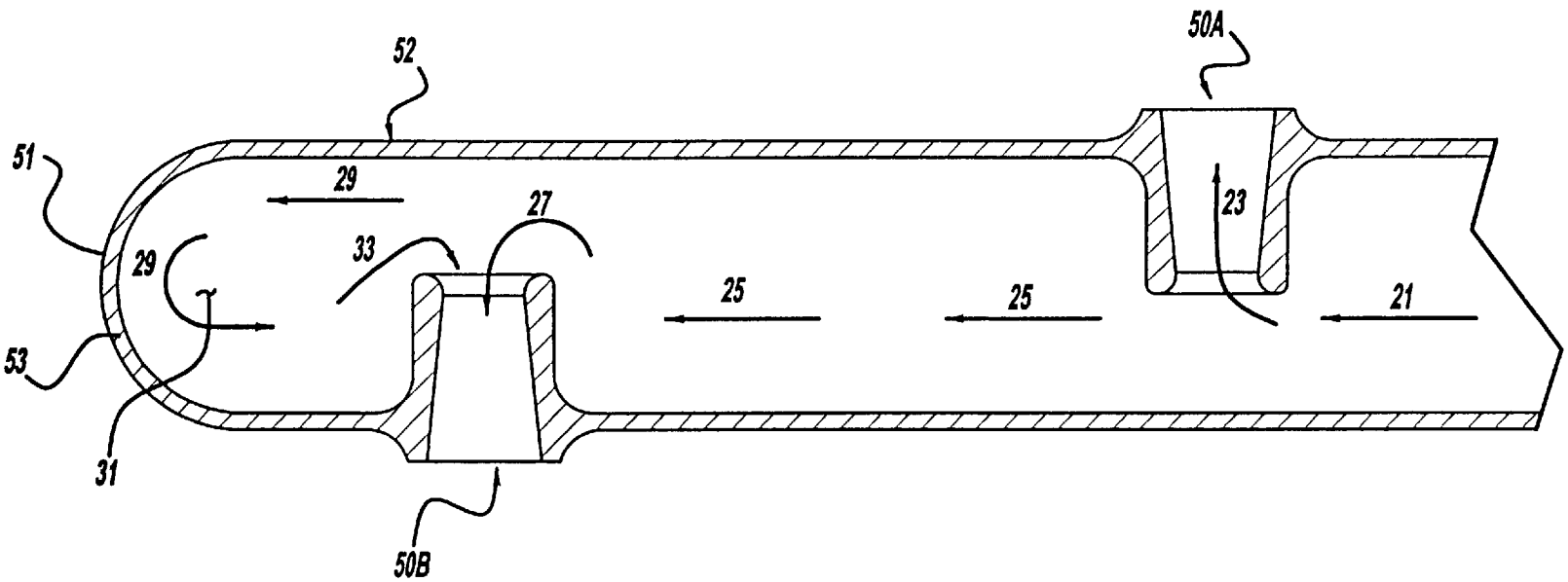
Figure - 2 Prior Art
FIG. 2 is a cross-sectional view of a sootblower nozzle block according to prior art teachings.

Now with reference to FIG. 2, a more detailed illustration of a nozzle block 52 according to prior art is provided. As shown, nozzle block 52 includes a pair of diametrically opposite positioned nozzles 50A and 50B. The nozzles 50A and 50B are displaced from the distal end 51, with nozzle 50B being referred to as the downstream nozzle (closer to distal end 51) and nozzle 50A being the upstream nozzle (farther from distal end 51).

The cleaning medium, typically steam under a gage pressure of about 150 psi or higher, flows into nozzle block 52 in the direction as indicated by arrow 21. A portion of the cleaning medium enters and is discharged from the upstream nozzle 50A as designated by arrow 23. A portion of the flow designated by arrows 25 passes the nozzle 50A and continues to flow toward downstream nozzle 50B. Some of that fluid directly exits nozzle 50B, designated by arrow 27. As explained above, the downstream nozzle 50B typically exhibits lower performance as compared to the upstream nozzle 50A. This is attributed to the fact that the flow of cleaning medium that passes the upstream nozzle 50A and downstream nozzle 50B designated by arrows 29 comes to a complete halt (stagnates) at the distal end 51 of the lance tube 14, thereby creating a stagnation region 31 at the distal end 51 beyond downstream nozzle 50B. Hence, the cleaning medium represented by arrow 33 has to re-accelerate, flow backward and merge with the incoming flow 27. The merging of the forward flow represented by arrow 27 and backward flow represented by arrow 33 results in loss of energy due to hydraulic losses at the nozzle inlet, and also results in flow mal-distribution. The loss of energy associated with stagnation conditions at the distal end and hydraulic losses at the nozzle inlet, and the deformation of the inlet flow profile is believed to be responsible for the downstream nozzle's lower performance in prior art designs.

As mentioned previously, there are various explanations for the comparatively lower performance of downstream nozzle 50B as compared with nozzle 50A. These inventors have found that the performance of downstream nozzle 50B is enhanced by eliminating the stagnation area at nozzle block distal end 51 and moving the stagnation area to the inlet of the downstream nozzle; in other words, substantially eliminating the cleaning medium flows represented by arrows 29 and 33 shown in FIG. 2. The advantages of this design concept can be described mathematically with reference to the following description and FIG. 2A.

One of the key parameters in designing an efficient convergent-divergent Laval nozzle, such as nozzles 50A and 50B, is the throat-to-exit area ratio (Ae/At). A nozzle with an ideal throat-to-exit area ratio would achieve uniform, fully expanded, flow at the nozzle exit plane. The amount of gas expansion in the divergent section is given by the following equation which characterizes cleaning medium flow as one-dimensional for the same of simplified calculation.

$$\frac{Ae}{At} = \frac{1}{Me}\left[\left(\frac{2}{\gamma+1}\right)\cdot\left(1+\frac{\gamma-1}{2}\cdot Me^2\right)\right]^{\frac{(\gamma+1)}{2(\gamma-1)}} \qquad \text{Equation 1}$$

Where,

Ae=Nozzle exit area

At=Throat area which is also equal to the area of the ideal sonic plane

The exit Mach number, Me, is related to the throat-to-exit area ratio via the continuity equation and the isentropic relations of an ideal gas (See Michael A. Saad, "Compressible Fluid Flow", Prentice Hall, Second Edition, page 98.)

$$Pe = Po\cdot\left(1+\frac{\gamma-1}{2}\cdot Me^2\right)^{\frac{\gamma}{1-\gamma}} \qquad \text{Equation 2}$$

Where,

γ=Specific heat ratio of cleaning fluid. For air γ=1.4. For steam, γ−1.329

Pe=Nozzle exit static pressure, psia

Po=Total pressure, psia

Me=Nozzle exit Mach number

In the above equation 2, the relationship between exit Mach number and the pressure ratio is based on the assumption that the flow reaches the speed of sound at the plane of the smallest cross-sectional area of the convergent-divergent nozzle, nominally the throat. However, in practice, especially in sootblower applications, the flow does not reach the speed of sound at the throat, and not even in the same plane. The actual sonic plane is usually skewered further downstream from the throat, and its shape becomes more non-uniform and three-dimensional.

The distortion of the sonic plane is mainly due to the flow mal-distribution into the nozzle inlet section. In sootblower applications, as shown by arrows 23 for nozzle 50A and arrows 33 and 27 for nozzle 50B in FIG. 2, the cleaning fluid approaches the nozzle at 90° off its center axis. With such configuration, the flow entering the nozzle favors the downstream half of the nozzle inlet section because the entry angle is less steep.

The distortion and dislocation of the sonic plane consequently impacts the expansion of the cleaning fluid in the divergent section, and results in non-uniformly distributed exit pressure and Mach number. These findings were consistent with the measured and predicted exit static pressure for one of the conventional sootblower nozzles.

To account for the shift in the sonic plane, the actual Mach number at the exit can be related to the ideal throat-to-exit area as follows:

$$\frac{Ae}{At}\cdot\frac{At}{At_a} = \frac{1}{Me_a}\left[\left(\frac{2}{\gamma+1}\right)\cdot\left(1+\frac{\gamma-1}{2}\cdot Me_a^2\right)\right]^{\frac{(\gamma+1)}{2(\gamma-1)}} \qquad \text{Equation 3}$$

Where,

At_a=Effective area of the actual sonic plane

Me_a=Average of the actual Mach number at the nozzle exit

The degree of mal-distribution of the exit Mach number and the static pressure varies between the upstream and downstream nozzles 50A and 50B respectively of a sootblower. It appears that the downstream nozzle 50B exhibits more non-uniform exit conditions than the upstream nozzle 50A, which is believed to be part of the cause of its relatively poor performance.

The location of the downstream nozzle 50B relative to the distal end 51 not only causes greater hydraulic losses, but also causes further misalignment of the incoming flow streams with the nozzle inlet. Again, greater flow mal-distribution at the nozzle inlet would translate to greater shift and distortion in the sonic plane, and consequently poorer performance. For the prior art designs, the ratio (At/At_a) is smaller for the downstream nozzle 50B compared to the upstream nozzle 50A.

In designing more efficient sootblower nozzles, it is necessary to keep the ideal and actual area ratio (At/At_a) closer to unity. Several methods are proposed in this discovery to accomplish this goal. For the upstream nozzle, the "At/At_a" ratio is in part influenced by dimension "X" and "α" shown in FIG. 2A, (At/At_a=f(α, X). Dimension X designates the longitudinal separation between nozzles 50A and 50B.

A smaller spacing X would cause the incoming flow stream 27 to become more mis-aligned with the upstream nozzle axis. For example, a five inch space for X has a relatively better performance than a four inch spacing for X.

While the greater X distance is beneficial, it is at the same time desired in most sootblower applications to keep X to a minimum for mechanical reasons. In such circumstances, an optimum X distance should be used which would minimize flow disturbance and yet satisfy mechanical requirements. Also, reducing the flow streams approach angle (α) shown in FIG. 2A would reduce flow mal-distribution at the nozzle inlet, and potentially reduce inlet losses.

Figure 2A:
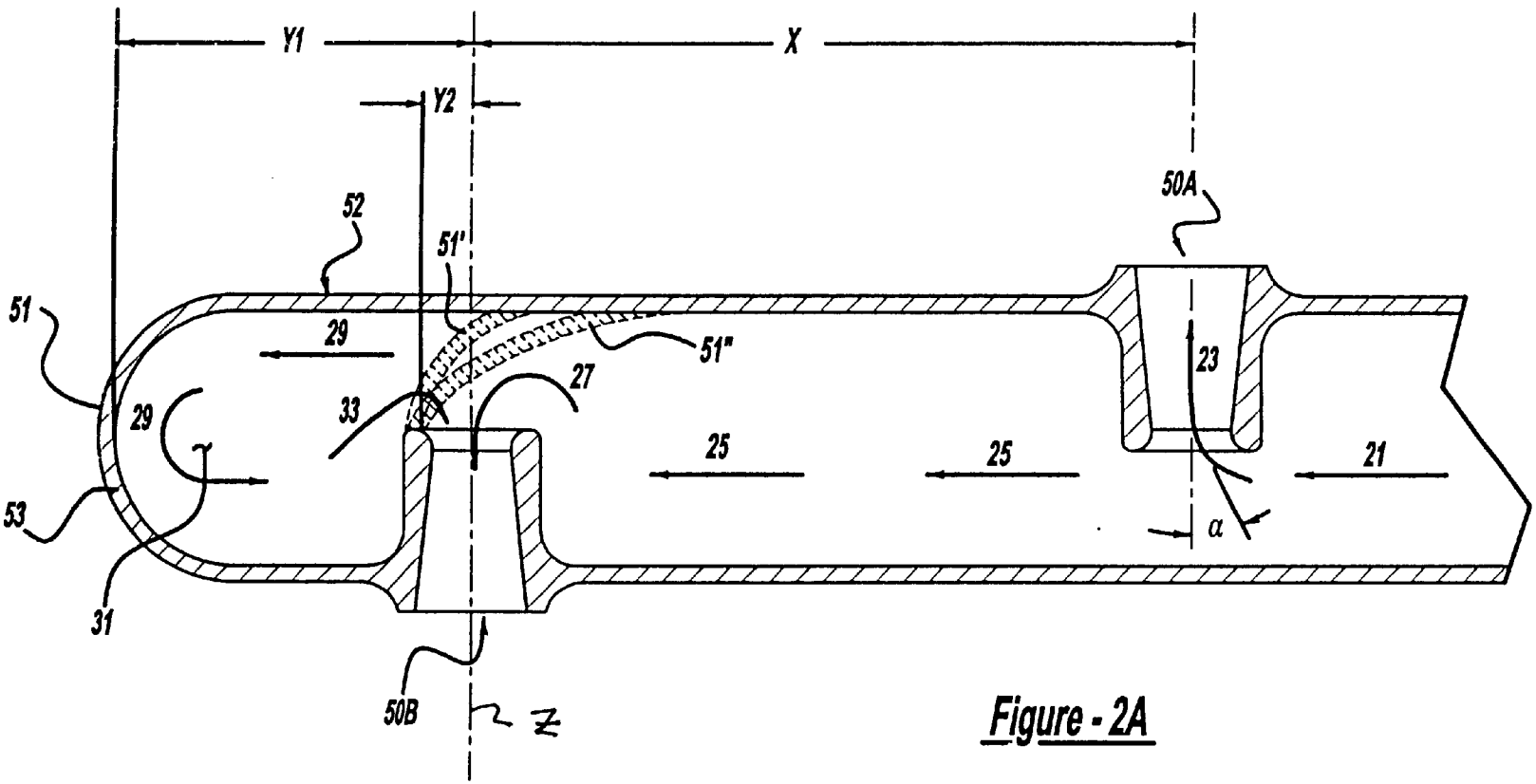
FIG. 2A is a cross section view similar to FIG. 2 but showing alternative stagnation regions for the nozzle head.

For downstream nozzle 50B, the "At/At_a" ratio is in part influenced by dimension "Y" shown in FIG. 2A, (At/At_a=f(Y)). Dimension Y is defined as the longitudinal distance between the inside surface of distal end 51 and the inlet axis of downstream nozzle 50B.

Again referring to FIG. 2A, the location of the distal plane relative to the downstream nozzle 50B, influences the alignment of the flow stream into the nozzle and cause greater flow mal-distribution. For instance, Y1 (which typifies the prior art) is the least favorable distance between the nozzle center axis and the distal end 51 of the lance tube. With such configuration, the nozzle performance is relatively poor. Y2 is an improved distance which is based on a modified distal end surface designated as 51'. In the case of Y2, the cleaning fluid 25 does not flow past the downstream nozzle 50B, therefore eliminating stagnation conditions of the flows represented by arrows 29 and 33. Instead the flow is efficiently channeled to the nozzle inlet. Thus, if the dimension Y is assumed positive in the left hand direction along the longitudinal axis of nozzle block 52 shown in FIG. 2A, there is an absence of any substantial flow of cleaning medium in the negative Y direction. Also, if the longitudinal axis (shown as a dashed line) of nozzle 50B defines a Z axis assumed positive in the direction of discharge from the nozzle, then it is further true that once the longitudinal point is reached along the nozzle block 52 where flow first begins to enter downstream nozzle 50B, there is a complete absence of any flow velocity vector having a negative Z component. In this way the hydraulic and energy losses at the nozzle inlet are minimized, improving the performance of downstream nozzle 50B. Furthermore, with this improvement the cleaning fluid enters the downstream nozzle 50B more uniformly, therefore minimizing the distortion of the sonic plane which in turn enhances the fluid expansion and the conversion of total pressure to kinetic energy. The optimal value of Y is substantially equal to Y2 which is one-half the diameter of the inlet end of downstream nozzle 50B.

On the other hand, providing a shape of the distal end inside surface to 51" is not beneficial. In such a configuration, the inlet flow area is reduced and the flow streams are further mis-aligned relative to the nozzle center axis, which could lead to flow separation and shedding.

Figure 3:
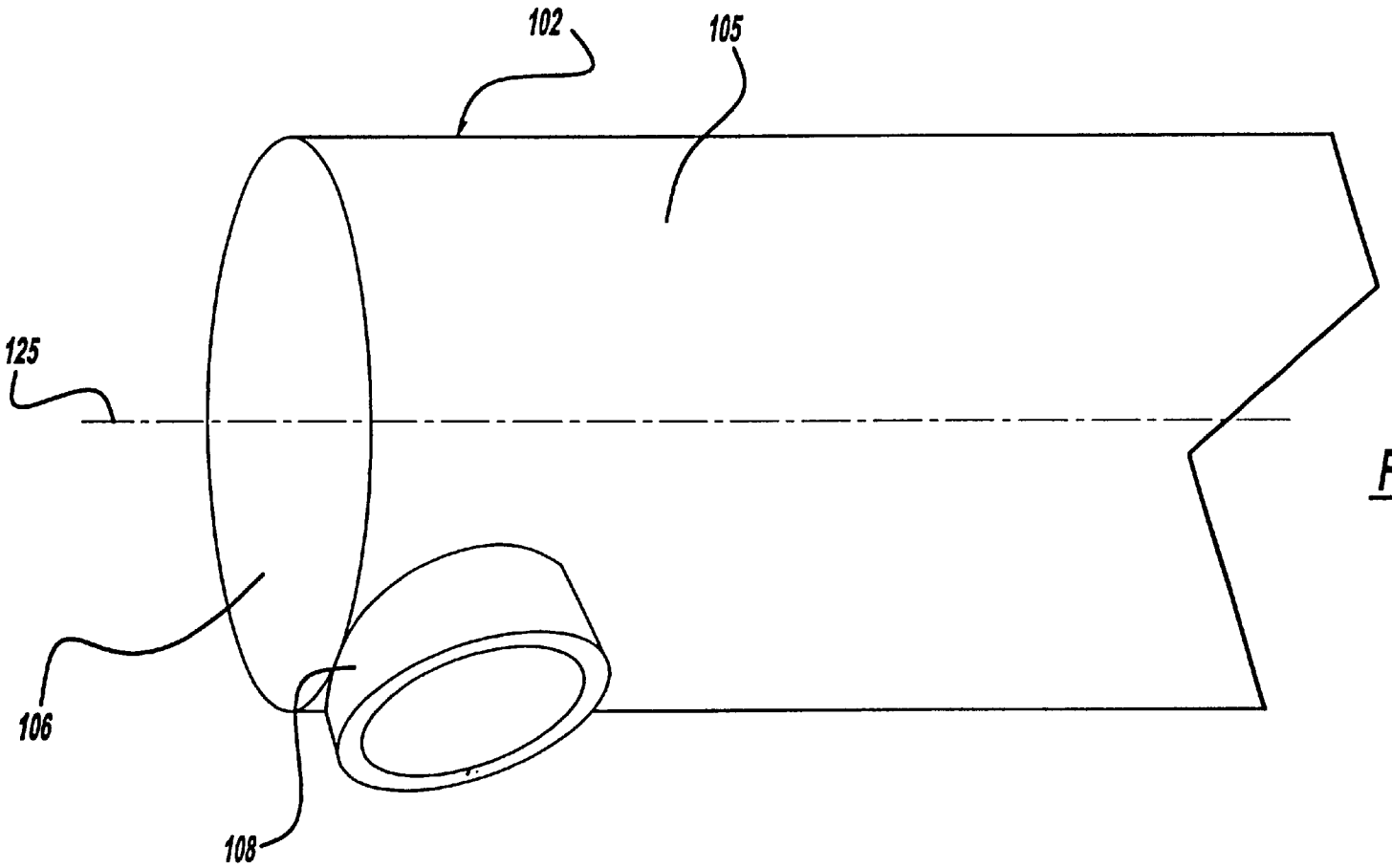
FIG. 3 is a perspective representation of a lance tube nozzle block incorporating the features according to a first embodiment of the invention.
Figure 4:
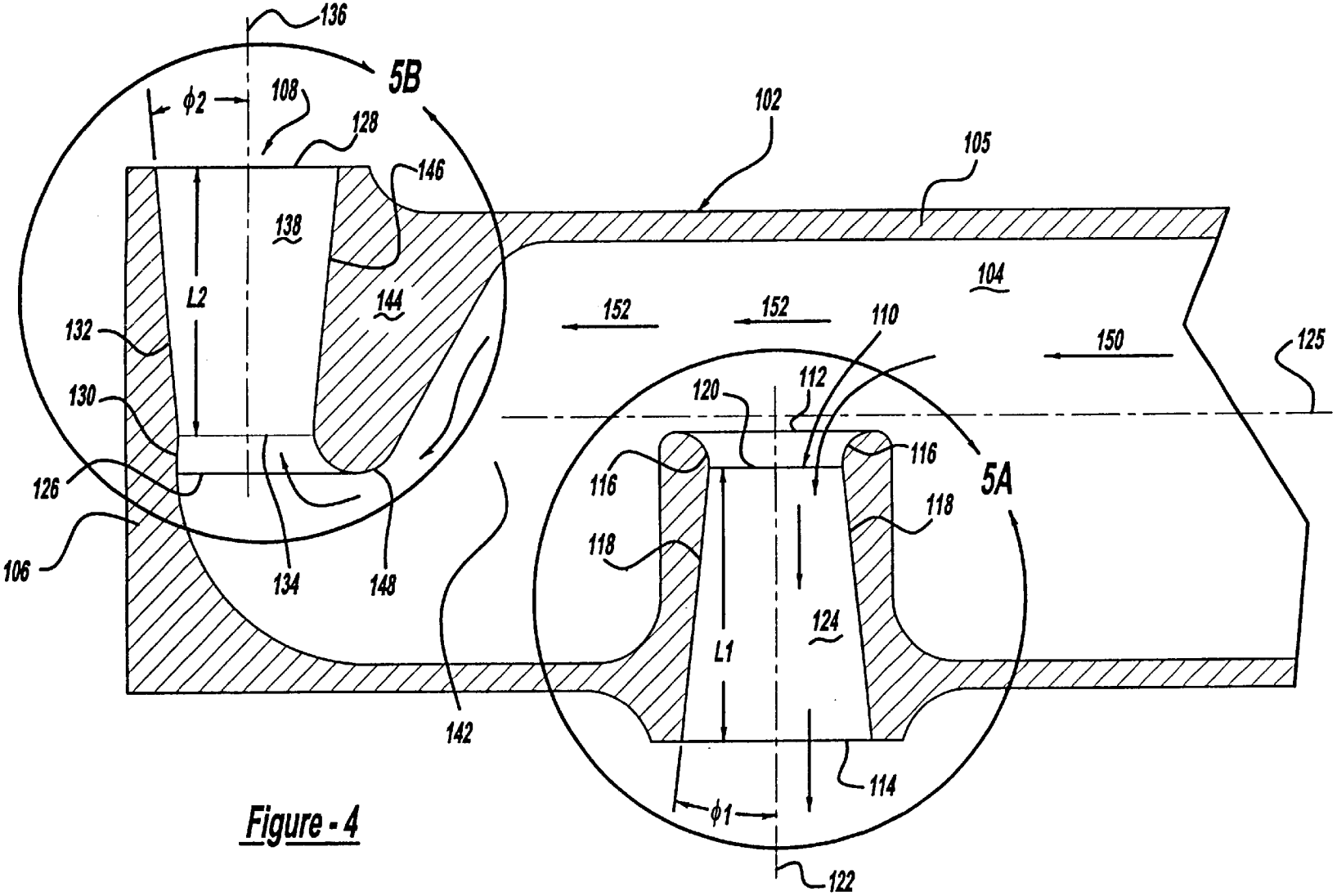
FIG. 4 is a cross section front view of the lance tube nozzle block according to the first embodiment of the present invention as shown in FIG. 3.

Now with reference to FIGS. 3 and 4, a lance tube nozzle block 102 in accordance with the teachings of the first embodiment of this invention is shown. The lance tube nozzle block 102 comprises a hollow interior body or plenum 104 having an exterior surface 105. The distal end of the lance tube nozzle block is generally represented by reference numeral 106. The lance tube nozzle block includes two nozzles 108 and 110 radially positioned and longitudinally spaced. Preferably, lance tube nozzle block 102 and the nozzles 108 and 110 are formed as one integral piece. Alternatively, it is also possible to weld the nozzles into the nozzle block 102.

FIG. 4 illustrates in detail the nozzles 108 and 110. As shown, the nozzle 108 is disposed at the distal end 106 of the lance tube nozzle block 102 and is commonly referred to as the downstream nozzle. The nozzle 110 disposed longitudinally away from the distal end 106 is commonly referred to as the upstream nozzle.

Figure 5A:
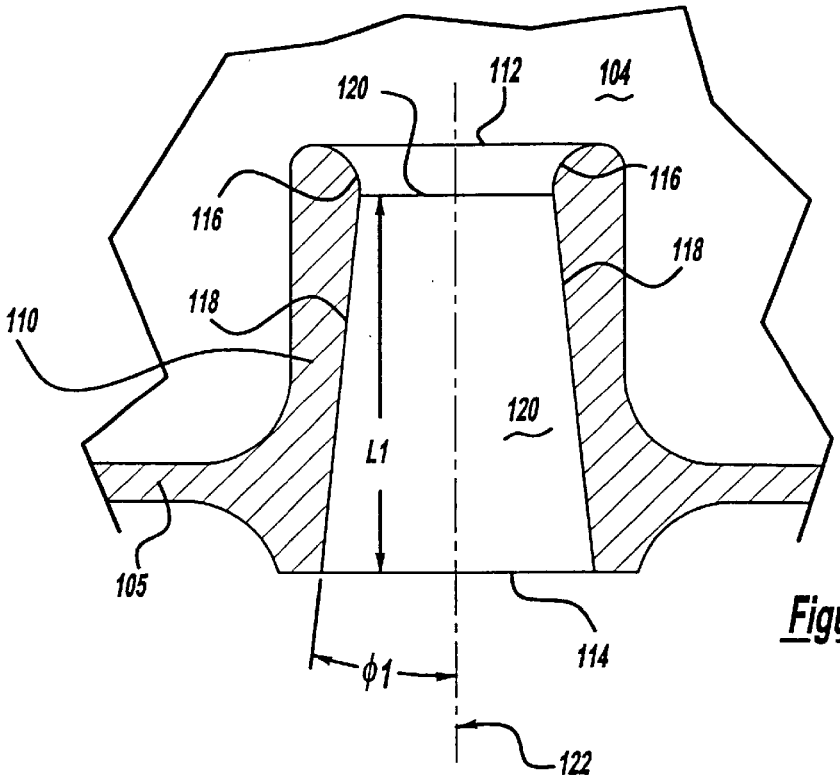
FIG. 5A is an enlarged cross-sectional view of the upstream nozzle in accordance with the teachings of the first embodiment of the present invention.

With reference to FIGS. 4 and 5A the upstream nozzle 110 is shown which is a typical converging and diverging nozzle of the well-known Laval configuration. In particular, the upstream nozzle 110 defines an inlet end 112 that is in communication with the interior body 104 of the lance tube nozzle block 102. The nozzle 110 also defines an outlet end 114 through which the cleaning medium is discharged. The converging wall 116 and the diverging wall 118 form the throat 120. The central axis 122 of the discharge of the nozzle 110 is substantially perpendicular to the longitudinal axis 125 of the lance tube nozzle block 102. However, it is also possible to have the central axis of discharge 122 oriented within an angle of about seventy degrees (70°) to about an angle substantially perpendicular to the longitudinal axis. The diverging wall 118 of the nozzle 110 defines a divergence angle ϕ1 as measured from the central axis of discharge 122. The nozzle 110 further defines an expansion zone 124 having a length L1 between the throat 120 and the outlet end 114.

Figure 5B:
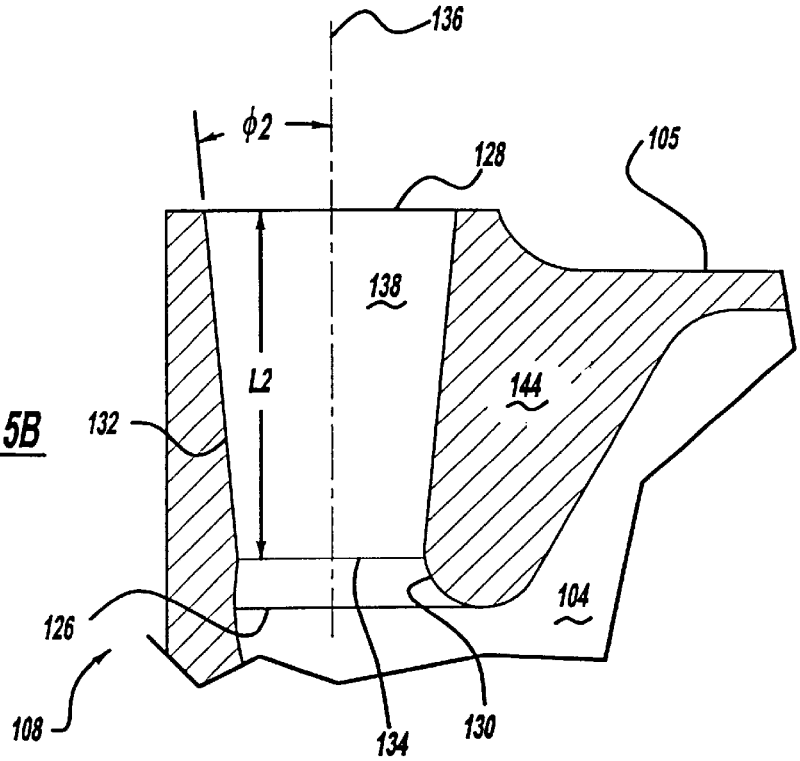
FIG. 5B is an enlarged cross-sectional view of the downstream nozzle in accordance with the teachings of the first embodiment of the present invention.

With reference to FIGS. 4 and 5B, the downstream nozzle 108 also comprises an inlet end 126 and outlet end 128 formed about axis 136. A portion of the cleaning medium not entering the upstream nozzle 110, enters the downstream nozzle 108 at the inlet end 126. The cleaning medium enters the inlet end 126 and exits the nozzle 108, through the outlet end 128. The converging wall 130 and the diverging wall 132 define the throat 134 of the downstream nozzle 108. The plane of the throat 134 is substantially parallel to the longitudinal axis 125 of the nozzle block. The diverging walls 132 of the downstream nozzle 108 are straight, i.e. conical in shape, but other shapes could be used. The central axis 136 of nozzle 108 is oriented within an angle of about seventy degrees (70°) to about an angle substantially perpendicular to the longitudinal axis 125 of the lance tube nozzle block 102. The nozzle 108 defines a divergent angle ϕ2 as measured from the central axis of discharge 136. An expansion zone 138 having a length L2 is defined between throat 134 and the outlet end 128.

Referring to FIG. 4, since the performance of a nozzle depends, in part, on the degree of expansion of the cleaning medium jet that exits through the nozzle. Preferably, the downstream nozzle 108 and the upstream nozzle 110 have identical geometry. Alternatively, the present invention may also incorporate downstream and upstream nozzle 108 and 110, respectively, having different geometry. In particular, the diameter of throat 134 of the downstream nozzle 108 may be larger than the diameter of throat 120 of the upstream nozzle 110. Further, the length L2 of the expansion chamber 138 may be greater than the length L1 of the expansion chamber 124 of the upstream nozzle 110. In an alternate embodiment, the diameter of the throat 134 is at least 5% larger than the diameter of throat 120 and the length L2 is at least 10% greater than length L1. Hence, the L/D ratio of the downstream nozzle 108 may be larger than the L/D ratio of the upstream nozzle 110.

As shown in FIG. 4, the flow of cleaning medium that passes the upstream nozzle 110 represented by arrow 152 is directed by a converging channel 142. The converging channel 142 is formed in the interior 104 of the lance tube nozzle block 102 between the upstream nozzle 110 and the downstream nozzle 108. The converging channel 142 is preferably formed by placing an aerodynamic converging contour body 144 around the surface of downstream nozzle throat 134. The converging channel 142 gradually decreases the cross-section of the interior 104 of the lance tube nozzle block 102 between the inlet end 112 of the upstream nozzle 110 and the inlet end 126 of the downstream nozzle 108. The tip 148 of the body 144 is in the same plane as the inlet end 126 of the nozzle 108. In the preferred embodiment, the contour body 144 is an integral part of the lance tube nozzle block 102 and the downstream nozzle 108. The contour body 144 has a sloping contour such that the flow of the cleaning medium will be directed toward the inlet end 126 of the downstream nozzle 108. Thus, converging channel 142 presents a cross-sectional flow area for the blowing medium which smoothly reduces from just past upstream nozzle 110 to the downstream nozzle 108 and turns the flow of cleaning medium to enter the downstream nozzle with reduced hydraulic losses.

As shown in FIG. 4, operation of nozzle block 102 in accordance with the first embodiment of the present invention is illustrated. The cleaning medium flows in the interior 104 of the lance tube nozzle block 102 in the direction shown by arrows 150. A portion of the cleaning medium enters the upstream nozzle 110 through the inlet end 112. The cleaning medium then enters the throat 120 where the medium may reach the speed of sound. The medium then enters the expansion chamber 124 where it is further accelerated and exits the upstream nozzle 110 at the outlet end 114.

A portion of the cleaning medium not entering the inlet end 112 of the upstream nozzle 110 flows towards the downstream nozzle 108 as indicated by arrows 152. The cleaning medium flows into the converging channel 142 formed in the interior 104 of the lance tube nozzle block 102. The converging channel 142 directs the cleaning medium to the inlet end 126 of the downstream nozzle 108. Therefore, the cleaning medium does not substantially flow longitudinally beyond the inlet end 126 of the downstream nozzle 108. In addition, once the flow reaches inlet end 126, there is no flow velocity component in the negative "Z" direction (defined as aligned with axis 136 and positive in the direction of flow discharge). Due to the presence of the converging channel 142, the flow of the cleaning medium is more efficiently driven to the nozzle inlet 126. The loss of energy associated with the cleaning medium entering the throat 134 of the downstream nozzle 108 is reduced, hence increasing the performance of the downstream nozzle 108. Unlike prior art designs, the flowing medium does not have to come to a complete halt in a region beyond the downstream nozzle and then re-accelerate to enter the inlet end 126 of the nozzle 108. Further, since it is also possible to have different geometry for the upstream nozzle 110 and the downstream nozzle 108, the cleaning medium entering the expansion zone 138 in the downstream nozzle 108 is expanded more than the cleaning medium in the expansion zone 124 of the upstream nozzle 110 so as to compensate for any nozzle inlet pressure difference between the nozzles 108 and 110. The kinetic energy of the cleaning medium exiting the downstream nozzle 108 more closely approximates the kinetic energy of the cleaning medium exiting the upstream nozzle 110.

Figure 6:
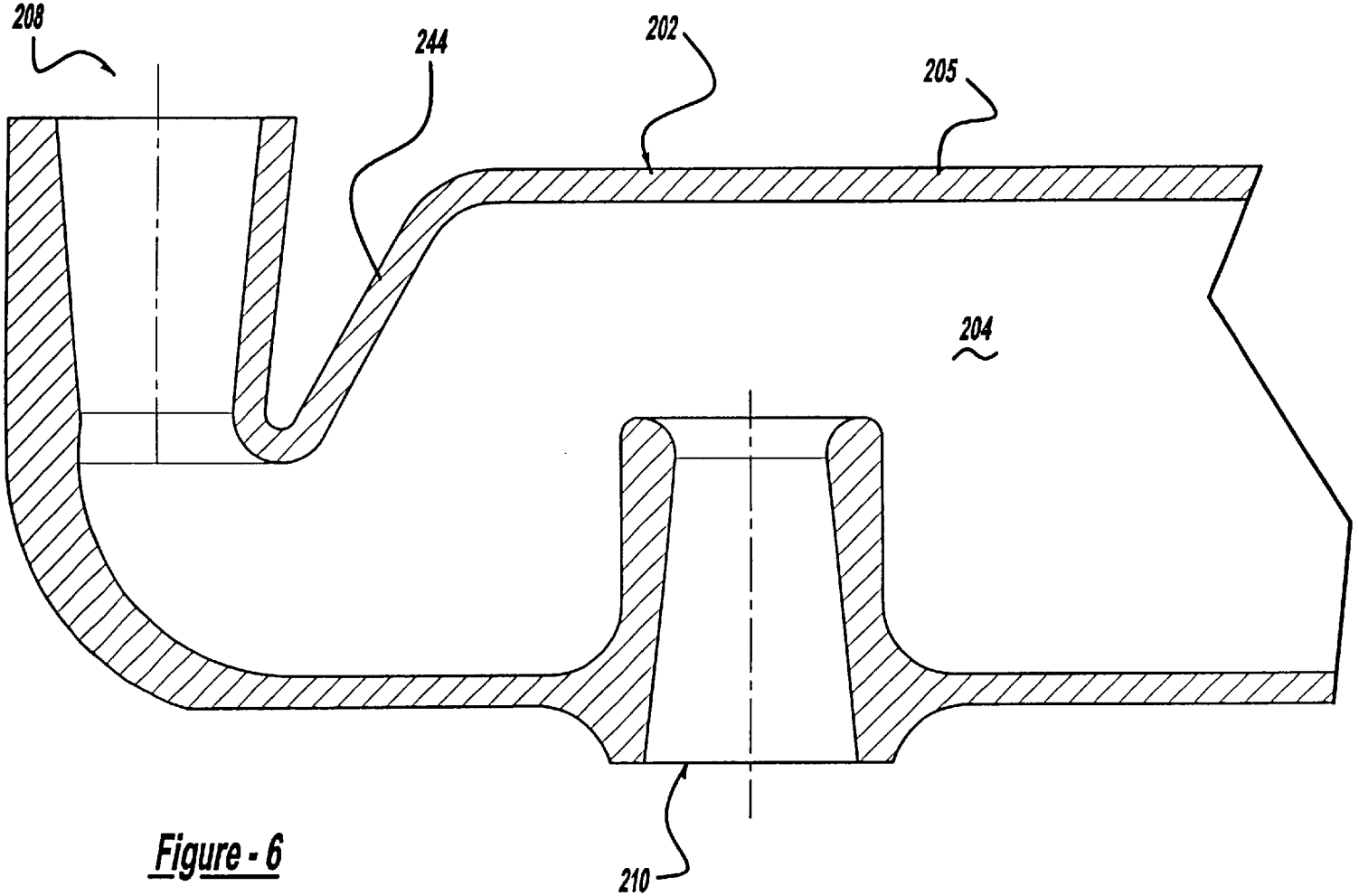
FIG. 6 is a cross-sectional front view of the lance tube nozzle block having a thin wall configuration in accordance with the teachings of the second embodiment of the present invention.

With particular reference to FIG. 6, a lance tube nozzle block 202 in accordance with the second embodiment of the present invention is shown. The lance tube nozzle block 202 is similar to the lance tube nozzle block 102 defining a hollow interior 204 and exterior surface 205. The lance tube nozzle block 202 has a downstream nozzle 208 and an upstream nozzle 210 that have identical configuration to nozzles 108 and 110 of the first embodiment. Further, the nozzle block 202 has identical internal volume and flow paths as the nozzle block 102.

The second embodiment differs from the first embodiment in the wall thickness of the nozzle block 202 is reduced. The flow obstruction 244 is hollow, thereby reducing the mass of the nozzle block 202.

Figure 7:
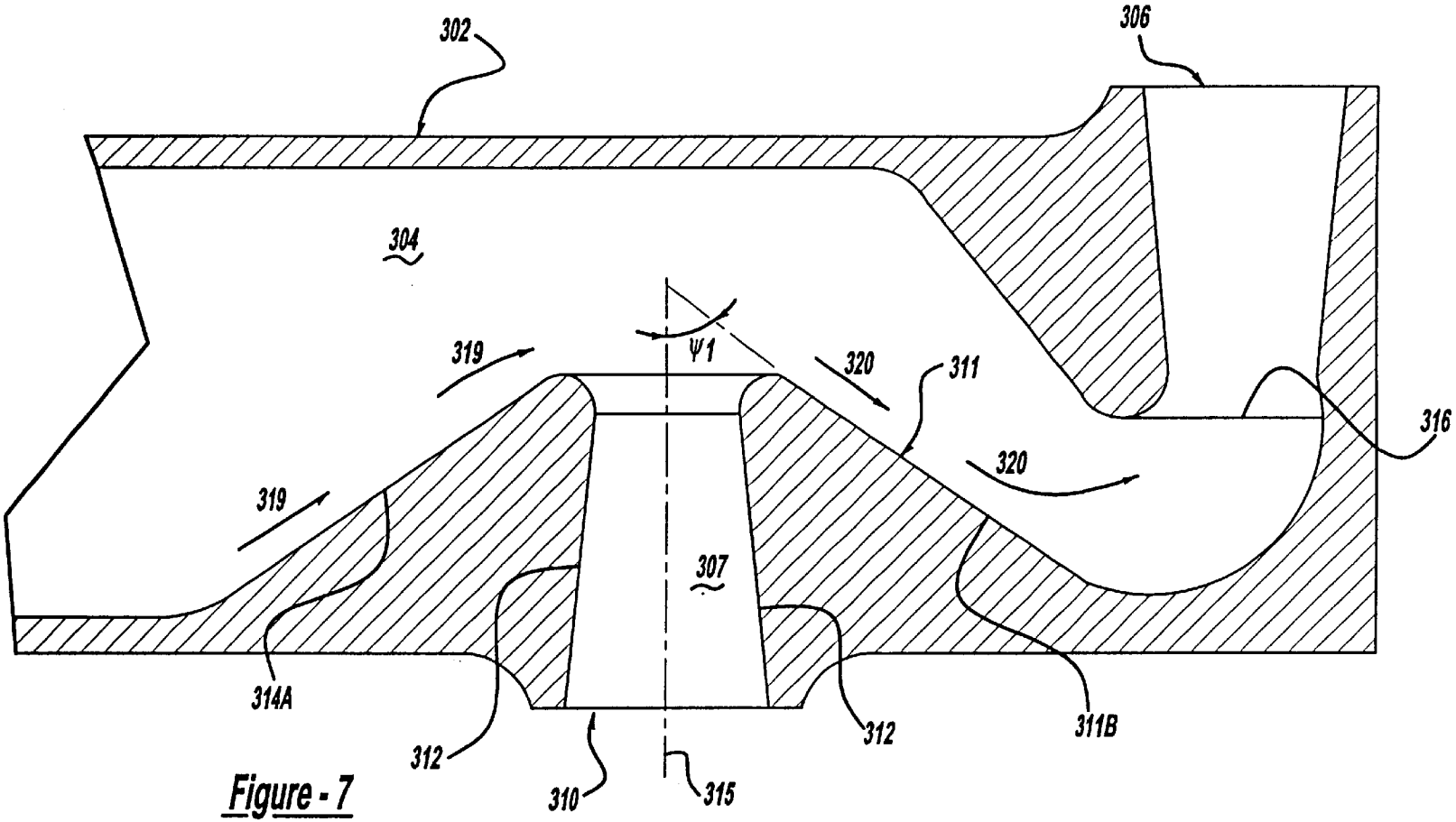
FIG. 7 is a cross-sectional front view of the lance tube nozzle block incorporating the airfoil or streamlining body around the upstream nozzle in accordance with the teachings of the third embodiment of the present invention.
Figure 7A:
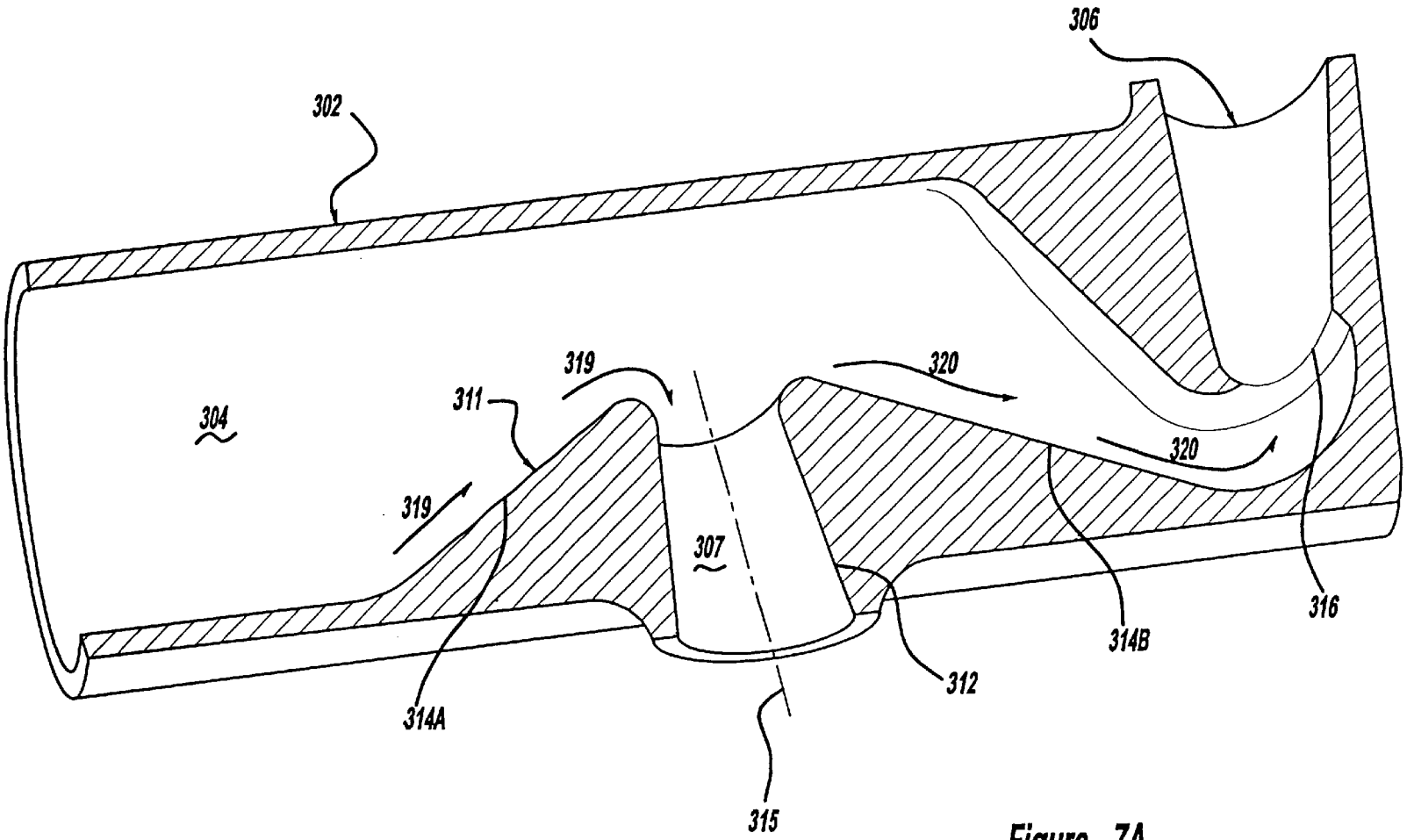
FIG. 7A is an elevated cross-section view of the lance tube nozzle block incorporating the airfoil body around the upstream nozzle in accordance with the teachings of the third embodiment of the present invention.
Figure 7B:
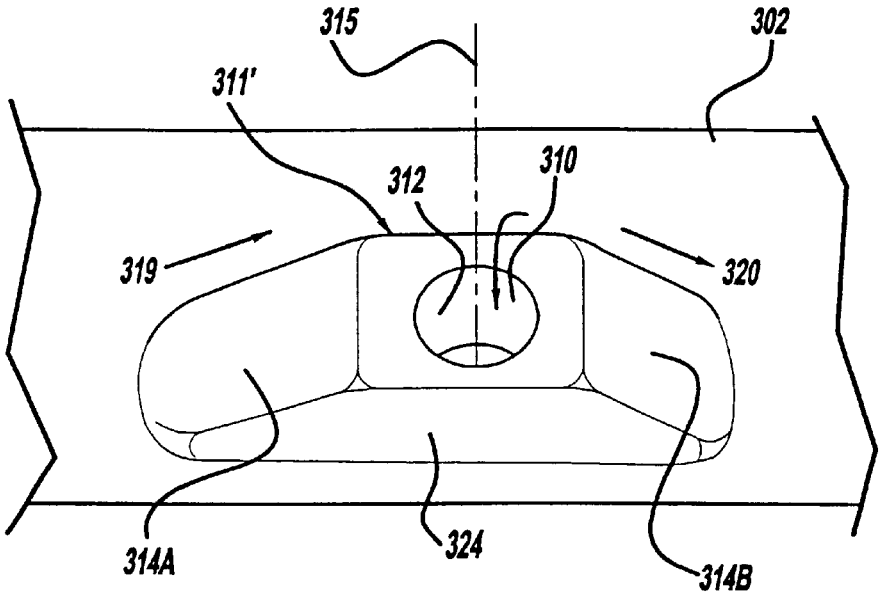
FIG. 7B is a top perceptive view of the lance tube nozzle block incorporating the airfoil body around the upstream nozzle wherein the external surface of the nozzle has a trapezoidal cross section in accordance with the teachings of the third embodiment of the present invention.

With reference to FIGS. 7, 7A and 7B, a lance tube nozzle block 302 for a sootblower in accordance with the teaching of the third embodiment of the present invention is shown. The lance tube nozzle block 302 includes a hollow interior 304. The lance tube nozzle block 302 includes a downstream nozzle 306 and an upstream nozzle 310. The dimension and geometry of the downstream and upstream nozzles 306 and 310, respectively, are identical to the dimension and geometry of the nozzles 108 and 110 of the first embodiment.

This embodiment of the lance tube nozzle block 302 differs from the previously described embodiment in that the upstream nozzle 310 includes an airfoil or streamline body 311 around the nozzle diverging surface 312 of the upstream nozzle 310. Preferably, the upstream nozzle airfoil body 311 has a trapezoidal cross section. The divergent section 307 (as shown in FIG. 7A) of the upstream nozzle 310 is circular at each point along its axis from the inlet to the exit plane. The airfoil body 311 has a smooth upstream incline surface 314A and a downstream incline surface 314B. The upstream incline surface 314A receives the cleaning medium from the proximate end of the nozzle block which flows in the direction as shown by arrows 319 in FIG. 7. The downward incline surface 314B allows a smooth flow of the cleaning medium past the upstream nozzle 310 to the inlet end 316 of the downstream nozzle 306 as shown by arrows 320. The angle of incline Ψ1 of the airfoil body 311 is measured between central axis 315 of upstream nozzle 310 and the inclining surface 314B of the airfoil body 311 as shown in FIG. 7. In the preferred embodiment the airfoil body 311 is made of same material as the nozzle block 302. The airfoil body 311 provides for a smooth flow of the cleaning medium to the inlet end 316 of the downstream nozzle 306 as shown by arrows 320. Further, the airfoil body 311 will help reduce the turbulent eddies influencing the upstream nozzle 310 and minimize pressure drop of the flow 320 that passes upstream nozzle 310 to feed the downstream nozzle 306. FIG. 7A is a sectional view of nozzle block 302 which is tipped slightly. This perspective helps to further illustrate the contours of hollow interior 304. FIG. 7B shows particularly a solidified form of airfoil body 311. This view shows that airfoil body 311', like airfoil body 311, includes side surfaces 324. Airfoil bodies 311 and 311' are configured to minimize obstructions of flow area past nozzle 310. This is, in part, provided by having side surface 324 closely approach these inside surfaces, 307, of nozzle 310.

Figure 8:
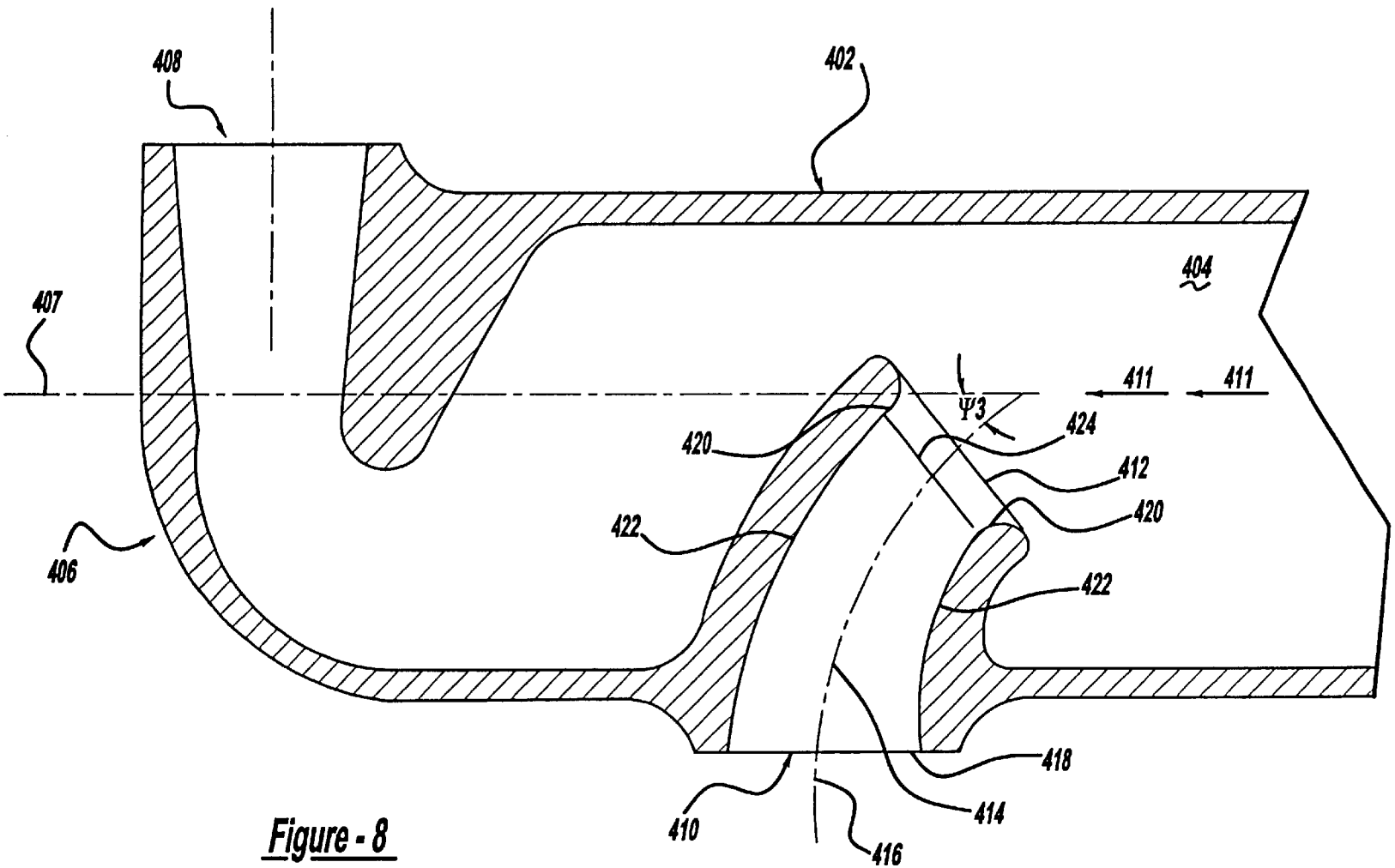
FIG. 8 is a cross-sectional representation of the lance tube nozzle block having a curved upstream nozzle with respect to the longitudinal axis of the lance tube in accordance with the fourth embodiment of the present invention.

Now referring to FIG. 8, a lance tube nozzle block 402 in accordance with the fourth embodiment of the present invention is illustrated. The lance tube nozzle block hollow interior 404 defines a longitudinal axis 407. The lance tube nozzle block 402 has a downstream nozzle 408, positioned at a distal end 406 of the lance tube nozzle block 402. The upstream nozzle 410 is longitudinally spaced from the downstream nozzle 408. In this embodiment, the downstream nozzle 408 has the same configuration as the nozzle 108 of the first embodiment. However, the geometry of the upstream nozzle 410 is different. In this embodiment, the upstream nozzle 410 has a curved interior shape such that the inlet end 412 curves towards the flow of the cleaning medium as shown by arrows 411. The central axis of discharge end 416 as measured from the inlet end 412 to the outlet end 418 is curved and not straight. The upstream nozzle 410 has converging walls 420 and diverging wall 422 joining the converging walls. The converging walls 420 and the diverging walls 422 define a throat 424. A central axis of throat 424 is curved such that the angle Ψ3 defined between the throat 424 and the longitudinal axis 407 of the nozzle block 402 is in the range of 0 to 90 degrees. Preferably the angle Ψ3 is equal to about 45 degrees.

Figure 9:
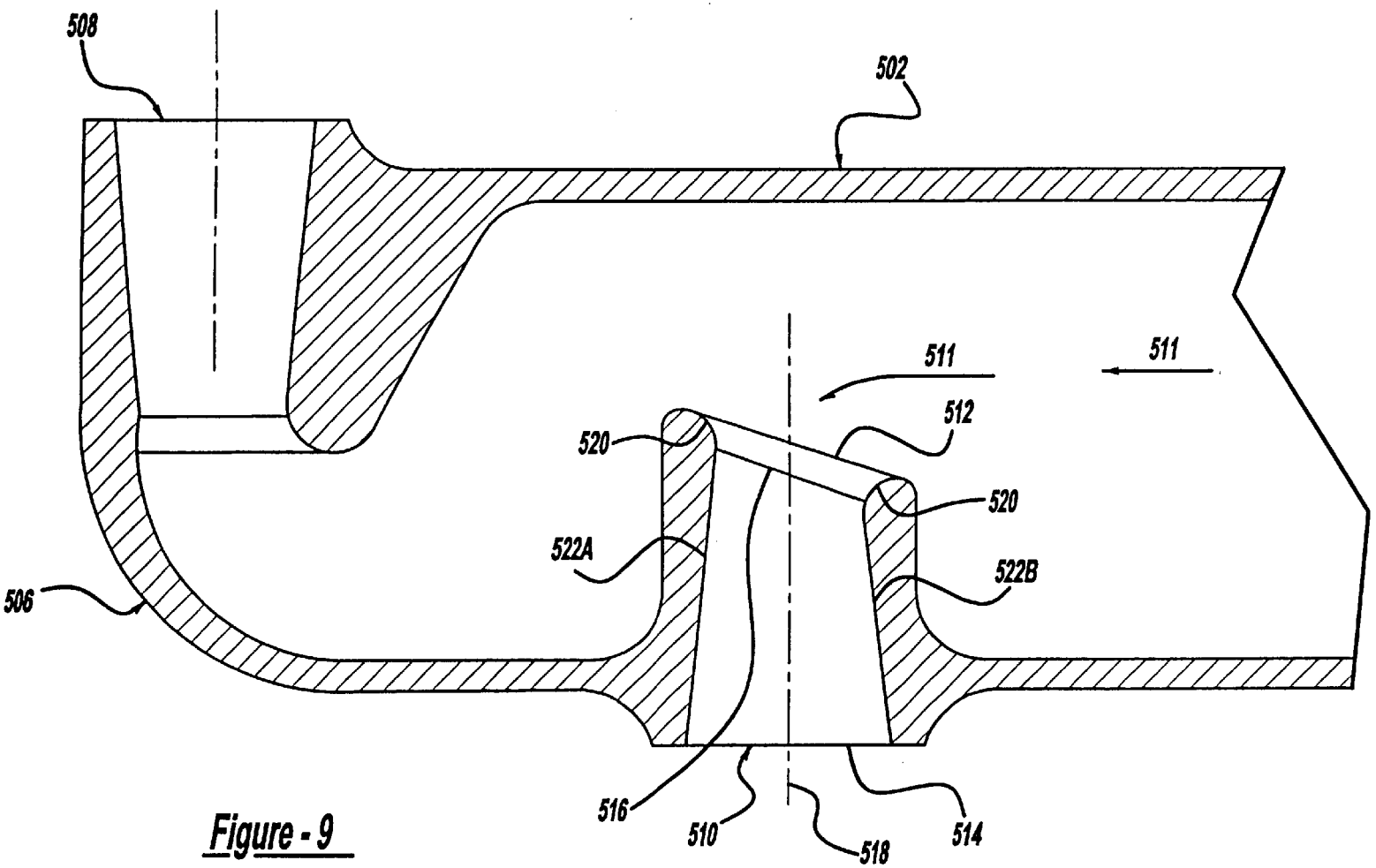
FIG. 9 is a cross-sectional representation of the lance tube nozzle block having an upstream nozzle with a straight discharge axis and a slanted inlet opening in accordance with the fifth embodiment of the present invention.

FIG. 9 represents a lance tube nozzle block 502 in accordance with the fifth embodiment of the present invention. The lance tube nozzle block 502 has identical configuration as the lance tube nozzle block in the fourth embodiment. The lance tube nozzle block 502 has a downstream nozzle 508 positioned at the distal end 506 of the lance tube nozzle block 502. The lance tube nozzle block 502 has an upstream nozzle 510 that defines an inlet end 512 and an outlet end 514. A throat 516 is defined by converging walls 520 and diverging walls 522.

The present embodiment differs from the nozzle geometry in the fourth embodiment in that the upstream nozzle 510 has a central axis 518, which is straight and not curved as described in the previous embodiment. The present embodiment has an inlet end 512 angled towards the flow of the cleaning medium, as shown by arrows 511. In order to have the inlet end 512 angled toward the flow of the cleaning medium, the converging and diverging walls 520 and 522, diametrically opposite each other are of different length. Thus, the diverging wall 522A is longer than the diverging wall 522B.

Figure 10:
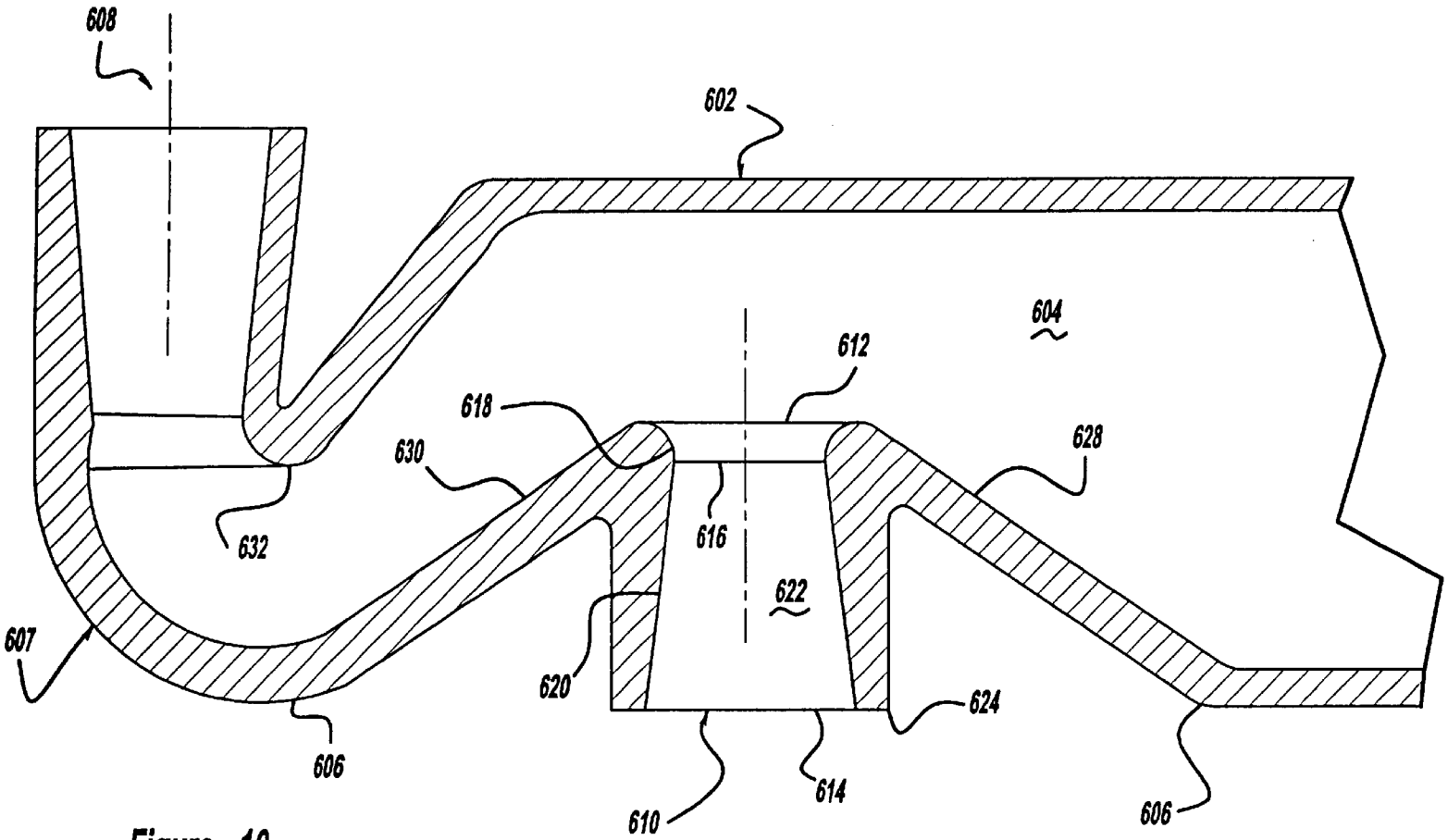
FIG. 10 is a cross-sectional representation of the lance tube nozzle block having a exit plane of the upstream nozzle flush with the outer diameter of the lance tube nozzle block and having a thin wall construction in accordance with the sixth embodiment of the present invention.

FIG. 10 represents the sixth embodiment of the present invention. The lance tube nozzle block 602 defines an interior surface 604 and an exterior surface 606. The downstream nozzle 608 is positioned at the distal end 607 of the lance tube nozzle block 602. The downstream nozzle 608 is of the same configuration and dimension as the nozzle 108 of the first embodiment.

The upstream nozzle 610 is a straight nozzle having an inlet end 612 and an outlet end 614. Like the upstream nozzle of the previous embodiments, the upstream nozzle 610 has a throat 616 defined by the converging walls 618 and diverging walls 620. The upstream nozzle 610 defines a central axis of discharge 622 between the inlet end 612 and the outlet end 614. In this embodiment, the plane 624 of the outlet end 614 is flush with the exterior surface 606 of the lance tube nozzle block 602. The nozzle expansion zone 622 provided by the diverging walls 620 is located entirely inside the diameter of lance tube nozzle block 602. Nozzle block 602 further features a "thin wall" construction in which the outer wall has a nearly uniform thickness, yet forms ramp surfaces 628 and 630, and tip 632.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

What is claimed is:

1. A lance tube nozzle block for a sootblower for cleaning internal heat exchanger surfaces by impingement of a jet of a cleaning medium, the nozzle block comprising:

a nozzle block body defining a longitudinal axis, a hollow interior, a distal end, and a proximate end with the proximate end receiving the cleaning medium;

a downstream nozzle positioned adjacent the distal end of the nozzle block body for discharging the cleaning medium, the downstream nozzle having a first inlet end, a first converging section near the first inlet end, a first diverging section joining the first converging section and terminating with a first outlet end, a first throat at the point where the first converging section and the first diverging section are joined, a first expansion zone between the first throat and the first outlet end, the downstream nozzle having a first axis of discharge substantially perpendicular to the nozzle block body longitudinal axis, the nozzle block body hollow interior and the downstream nozzle cooperating such that the cleaning medium flowing in the direction of the longitudinal axis from the proximate end to the distal end through the nozzle block body hollow interior does not flow substantially beyond the downstream nozzle first inlet end; and an upstream nozzle for discharging the cleaning medium positioned at a longitudinal position of the lance tube nozzle block displaced from the distal end and the downstream nozzle, the upstream nozzle having a second inlet end, a second outlet end, wherein the cleaning medium enters the upstream nozzle through the second inlet end and exits through the second outlet end with a second axis of discharge substantially perpendicular to the nozzle block body longitudinal axis, a second converging section near the second inlet end, a second diverging section joining the second converging section defining a second throat, and a second expansion zone between the second throat and the second outlet end.

2. The nozzle block of claim 1 wherein the downstream nozzle first expansion zone defines a first expansion length and the first throat defines a first diameter, and the upstream nozzle second expansion zone defines a second expansion length and the second throat defines a second diameter, and wherein the ratio of the first expansion length to the first diameter is different than the ratio of the second expansion length to the second diameter.

3. The nozzle block of claim 1 wherein the downstream nozzle first expansion zone defines a first expansion length and the first throat defines a first diameter, and the upstream nozzle second expansion zone defines a second expansion length and the second throat defines a second diameter, and wherein the ratio of the first expansion length to the first diameter is equal to the ratio of the second expansion length to the second diameter.

4. The nozzle block of claim 1 wherein the nozzle block body defines an exterior surface and the second outlet end is substantially within the cylinder defined by the exterior surface of the nozzle block body.

5. The nozzle block of claim 1 wherein the nozzle block body defines an exterior surface and the first outlet end is substantially within the cylinder defined by the exterior surface of the nozzle block body.

6. The nozzle block of claim 1 wherein the cleaning medium is comprised at least in part of steam.

7. The nozzle block of claim 1 adapted to be connected with a lance tube, the nozzle block and the lance tube having a cylindrical exterior surface with both the downstream nozzle and the upstream nozzle located within the cylindrical surface.

8. A lance tube nozzle block for a sootblower for cleaning internal heat exchanger surfaces by impingement of a jet of a cleaning medium, the nozzle block comprising:

a nozzle block body defining a longitudinal axis, a hollow interior, a distal end, and a proximate end with the proximate end receiving the cleaning medium;

a downstream nozzle positioned adjacent the distal end of the nozzle block body for discharging the cleaning medium, the downstream nozzle having an inlet end and an axis of discharge substantially perpendicular to the nozzle block body longitudinal axis, the nozzle block body hollow interior and the downstream nozzle cooperating such that the cleaning medium flowing in the direction of the longitudinal axis from the proximate end to the distal end through the nozzle block body interior does not flow substantially beyond the downstream nozzle inlet end; and an upstream nozzle for discharging the cleaning medium positioned at a longitudinal position of the lance tube nozzle block displaced from the distal end and the downstream nozzle;

wherein the upstream nozzle creates a stream of the cleaning medium directed in a direction which is diametrically opposite the direction of a stream of the cleaning medium created by the downstream nozzle.

9. The nozzle block of claim 8 wherein the cleaning medium is comprised at least in part of steam.

10. The nozzle block of claim 8 adapted to be connected with a lance tube, the nozzle block and the lance tube having a cylindrical exterior surface with both the downstream nozzle and the upstream nozzle located within the cylindrical surface.

11. A lance tube nozzle block for a sootblower for cleaning internal heat exchanger surfaces by impingement of a jet of a cleaning medium, the nozzle block comprising:

a nozzle block body defining a longitudinal axis, a hollow interior, a distal end, and a proximate end with the proximate end receiving the cleaning medium;

a downstream nozzle positioned adjacent the distal end of the nozzle block body for discharging the cleaning medium, the downstream nozzle having an inlet end and an axis of discharge substantially perpendicular to the nozzle block body longitudinal axis, the nozzle block body hollow interior and the downstream nozzle cooperating such that the cleaning medium flowing in the direction of the longitudinal axis from the proximate end to the distal end through the nozzle block body interior does not flow substantially beyond the downstream nozzle inlet end;

wherein the nozzle block body hollow interior defines a converging channel of decreasing cross-sectional area at all points distal of the downstream nozzle; and an upstream nozzle for discharging the cleaning medium positioned at a longitudinal position of the lance tube nozzle block displaced from the distal end and the downstream nozzle.

12. The nozzle block of claim 11 wherein the converging channel is defined at least in part by a contoured body disposed adjacent the downstream nozzle inlet end and defining a surface of the hollow interior of the nozzle block body.

13. The nozzle block of claim 12 wherein a tip of the contoured body in part defines the downstream nozzle inlet end.

14. The nozzle block of claim 11 wherein the cleaning medium is comprised at least in part of steam.

15. The nozzle block of claim 11 adapted to be connected with a lance tube, the nozzle block and the lance tube having a cylindrical exterior surface with both the downstream nozzle and the upstream nozzle located within the cylindrical surface.

16. A lance tube nozzle block for a sootblower for cleaning internal heat exchanger surfaces by impingement of a jet of a cleaning medium, the nozzle block comprising:

a nozzle block body defining a longitudinal axis, a hollow interior, a distal end, and a proximate end with the proximate end receiving the cleaning medium;

a downstream nozzle positioned adjacent the distal end of the nozzle block body for discharging the cleaning medium, the downstream nozzle having an inlet end and an axis of discharge substantially perpendicular to the nozzle block body longitudinal axis, the nozzle block body hollow interior and the downstream nozzle cooperating such that the cleaning medium flowing in the direction of the longitudinal axis from the proximate end to the distal end through the nozzle block body interior does not flow substantially beyond the downstream nozzle inlet end;

an upstream nozzle for discharging the cleaning medium positioned at a longitudinal position of the lance tube nozzle block displaced from the distal end and the downstream nozzle; and wherein an airfoil body surrounds the upstream nozzle and defines a portion of the hollow interior of the nozzle block body.

17. The nozzle block of claim 16 wherein the airfoil body has an upstream incline to direct the flow of the cleaning medium from the nozzle block proximate end to the upstream nozzle and a downstream incline to direct the cleaning medium towards the downstream nozzle past the upstream nozzle.

18. The nozzle block of claim 16 wherein the cleaning medium is comprised at least in part of steam.

19. The nozzle block of claim 16 adapted to be connected with a lance tube, the nozzle block and the lance tube having a cylindrical exterior surface with both the downstream nozzle and the upstream nozzle located within the cylindrical surface.

20. A lance tube nozzle block for a sootblower for cleaning internal heat exchanger surfaces by impingement of a jet of a cleaning medium, the nozzle block comprising:

a nozzle block body defining a longitudinal axis, a hollow interior, a distal end, and a proximate end with the proximate end receiving the cleaning medium;

a downstream nozzle positioned adjacent the distal end of the nozzle block body for discharging the cleaning medium, the downstream nozzle having an inlet end and an axis of discharge substantially perpendicular to the nozzle block body longitudinal axis, the nozzle block body hollow interior and the downstream nozzle cooperating such that the cleaning medium flowing in the direction of the longitudinal axis from the proximate end to the distal end through the nozzle block body interior does not flow substantially beyond the downstream nozzle inlet end;

wherein the nozzle block body hollow interior and the downstream nozzle define a distance (Y) measured along the nozzle block body longitudinal axis from the downstream nozzle axis of discharge to an inside surface of the hollow interior at the distal end and wherein the distance (Y) is not substantially greater than one-half the diameter of the downstream nozzle inlet end; and an upstream nozzle for discharging the cleaning medium positioned at a longitudinal position of the lance tube nozzle block displaced from the distal end and the downstream nozzle.

21. The nozzle block of claim 20 wherein the flow of cleaning medium in the direction of the longitudinal axis is assumed positive from the proximate end to the distal end and once the cleaning medium enters the downstream nozzle inlet, there is an absence of the flow of the cleaning medium in the negative (Y) direction.

22. The nozzle block of claim 20 wherein the cleaning medium is comprised at least in part of steam.

23. The nozzle block of claim 20 adapted to be connected with a lance tube, the nozzle block and the lance tube having a cylindrical exterior surface with both the downstream nozzle and the upstream nozzle located within the cylindrical surface.

24. A lance tube nozzle block for a sootblower for cleaning internal heat exchanger surfaces by impingement of a jet of a cleaning medium, the nozzle block comprising:

a nozzle block body defining a longitudinal axis, a hollow interior, a distal end, and a proximate end with the proximate end receiving the cleaning medium;

a downstream nozzle positioned adjacent the distal end of the nozzle block body for discharging the cleaning medium, the downstream nozzle having an inlet end and an axis of discharge substantially perpendicular to the nozzle block body longitudinal axis, the nozzle block body hollow interior and the downstream nozzle cooperating such that the cleaning medium flowing in the direction of the longitudinal axis from the proximate end to the distal end through the nozzle block body interior does not flow substantially beyond the downstream nozzle inlet end; and an upstream nozzle for discharging the cleaning medium positioned at a longitudinal position of the lance tube nozzle block displaced from the distal end and the downstream nozzle; and wherein the upstream nozzle axis of discharge is tipped from perpendicular to the nozzle block body longitudinal axis toward the proximate end.

25. The nozzle block of claim 24 wherein the upstream nozzle axis of discharge defines a curved line.

26. The nozzle block of claim 25 wherein the nozzle block body has a substantially uniform wall thickness.

27. The nozzle block of claim 24 wherein the axis of discharge defines a straight line.

28. The nozzle block of claim 24 wherein the cleaning medium is comprised at least in part of steam.

29. The nozzle block of claim 24 adapted to be connected with a lance tube, the nozzle block and the lance tube having a cylindrical exterior surface with both the downstream nozzle and the upstream nozzle located within the cylindrical surface.

30. A lance tube nozzle block for a sootblower for cleaning internal heat exchanger surfaces by impingement of a jet of a cleaning medium, the nozzle block comprising:

a nozzle block body defining a longitudinal axis, a hollow interior, a distal end, and a proximate end with the proximate end receiving the cleaning medium;

a downstream nozzle positioned adjacent the distal end of the nozzle block body for discharging the cleaning medium, the downstream nozzle having an inlet end and an axis of discharge substantially perpendicular to the nozzle block body longitudinal axis, the nozzle block body hollow interior and the downstream nozzle cooperating such that the cleaning medium flowing in the direction of the longitudinal axis from the proximate end to the distal end through the nozzle block body interior does not flow substantially beyond the downstream nozzle inlet end;

wherein the downstream nozzle axis of discharge defines an axis (Z) and wherein once the flow of the cleaning medium reaches the inlet end of the downstream nozzle, there is an absence of any cleaning medium flow component in the negative Z direction; and an upstream nozzle for discharging the cleaning medium positioned at a longitudinal position of the lance tube nozzle block displaced from the distal end and the downstream nozzle.

31. The nozzle block of claim 30 wherein the cleaning medium is comprised at least in part of steam.

32. The nozzle block of claim 30 adapted to be connected with a lance tube, the nozzle block and the lance tube having a cylindrical exterior surface with both the downstream nozzle and the upstream nozzle located within the cylindrical surface.

33. A lance tube nozzle block for a sootblower for cleaning internal heat exchanger surfaces by impingement of a jet of a cleaning medium, the nozzle block comprising:

a nozzle block body defining a longitudinal axis, a hollow interior, a distal end, a proximate end with the proximate end receiving the cleaning medium;

a downstream nozzle positioned adjacent the distal end of the nozzle block body for discharging the cleaning medium, the downstream nozzle having an inlet end and an axis of discharge substantially perpendicular to the nozzle block body longitudinal axis, the nozzle block body hollow interior and the downstream nozzle cooperating such that the cleaning medium flowing in the direction of the longitudinal axis from the proximate end to the distal end through the nozzle block body interior does not flow substantially beyond the downstream nozzle inlet end; and an upstream nozzle for discharging the cleaning medium positioned at a displaced longitudinal position of the lance tube nozzle block from the distal end, wherein said upstream nozzle creates a stream of the cleaning medium directed in a direction which is diametrically opposite the direction of a stream of the cleaning medium created by the downstream nozzle and wherein the hollow interior defines a converging channel of smoothly decreasing cross-sectional area between the upstream nozzle and the downstream nozzle for directing the flow of the cleaning medium past the upstream nozzle to the downstream nozzle inlet end.

34. The nozzle block of claim 33 wherein the downstream nozzle includes a first converging section near the downstream nozzle inlet end, a first diverging section joining the first converging section and terminating with a first outlet end, a first throat at the point where the first converging section and the first diverging section are joined, a first expansion zone between the first throat and the first outlet end; and the upstream nozzle having a second inlet end and a second outlet end, wherein the cleaning medium enters the upstream nozzle through the second inlet end and exits the nozzle block through the second outlet end with a second axis of discharge substantially perpendicular to the longitudinal axis of the upstream nozzle block body, a second converging section near the second inlet end, a second diverging section joining the second converging section defining a second throat, and a second expansion zone between the second throat and the second outlet end.

35. The nozzle block of claim 34 wherein the first throat defines a first diameter, the first expansion zone defines a first expansion length, and the second throat defines a second diameter, the second expansion zone defines a second expansion length, and wherein the ratio of the first expansion length to the first diameter is different than the ratio of the second expansion length to the second diameter.

36. The nozzle block of claim 34 wherein the first throat defines a first diameter, the first expansion zone defines a first expansion length, and the second throat defines a second diameter, the second expansion zone defines a second expansion length, and wherein the ratio of the first expansion length to the first diameter is the same as the ratio of the second expansion length to the second diameter.

37. The nozzle block of claim 33 wherein the nozzle block defines an exterior surface and at least one of the first outlet end and the second outlet end is substantially within the cylinder defined by the exterior surface of the nozzle block body.

38. The nozzle block of claim 33 wherein the converging channel is defined at least in part by a contoured body disposed adjacent the downstream nozzle inlet end.

39. The nozzle block of claim 38 wherein the contoured body defines a tip and the tip in part defines the downstream nozzle inlet end.

40. The nozzle block of claim 38 wherein an airfoil body surrounds the upstream nozzle and defines a portion of the hollow interior of the nozzle block body.

41. The nozzle block of claim 40 wherein the airfoil body has an upstream incline to direct the flow of the cleaning medium from the proximate end of the nozzle block body to the upstream nozzle second inlet end and a downstream incline to direct the cleaning medium toward the downstream nozzle past the upstream nozzle.

42. The nozzle block of claim 33 wherein the cleaning medium is comprised at least in part of steam.

43. The nozzle block of claim 33 wherein the nozzle block body hollow interior and the downstream nozzle define a distance (Y) measured along the nozzle block body longitudinal axis from the downstream nozzle axis of discharge to an inside surface of the hollow interior at the distal end and wherein the distance (Y) is not substantially greater than one-half the diameter of the downstream nozzle inlet end.

44. The nozzle block of claim 43 wherein the flow of the cleaning medium in the direction of the longitudinal axis is assumed positive from the proximate end to the distal end and once the cleaning medium enters the downstream nozzle inlet end, there is an absence of flow of the cleaning medium in the negative direction.

45. The nozzle block of claim 43 wherein the upstream nozzle defines a second axis of discharge which is tipped from perpendicular to the nozzle block body longitudinal axis toward the proximate end.

46. The nozzle block of claim 45 wherein the second axis of discharge defines a curved line.

47. The nozzle block of claim 45 wherein the second axis of discharge defines a straight line.

48. The nozzle block of claim 33 wherein the nozzle block body has a substantially uniform wall thickness.

49. The nozzle block of claim 33 wherein the downstream axis of discharge defines an axis (Z) and wherein once the flow of the cleaning medium reaches the inlet end of the downstream nozzle, there is an absence of any cleaning medium flow component in the negative Z direction.

50. A lance tube nozzle block for a sootblower for cleaning internal heat exchanger surfaces by impingement of a jet of a compressible cleaning medium, the nozzle block comprising:

a nozzle block body defining a longitudinal axis, a hollow interior, a distal end, and a proximate end with the proximate end receiving the cleaning medium;

a downstream nozzle positioned adjacent the distal end of the nozzle block body for discharging the cleaning medium, the downstream nozzle having an inlet end and an axis of discharge substantially perpendicular to the nozzle block body longitudinal axis;

an upstream nozzle for discharging the cleaning medium positioned at a displaced longitudinal position of the lance tube nozzle block from the distal end and the upstream nozzle; and an airfoil body integrally surrounding the upstream nozzle in communication with the hollow interior of the nozzle block body, and the airfoil body defining a surface of the hollow interior of the nozzle block body, such that the airfoil body provides a smooth flow for the cleaning medium from the upstream nozzle to the downstream nozzle.

51. The nozzle block of claim 50 wherein the airfoil body has a sloping geometry having an upstream incline and a downstream incline, the upstream incline directing the flow of the cleaning medium from the proximate end of the nozzle block body to the upstream nozzle and the downstream incline directing the flow of cleaning medium past the upstream nozzle to the downstream nozzle.

52. The nozzle block of claim 50 wherein the airfoil body reduces the presence of eddy current around a downstream surface of the upstream nozzle to thereby act to reduce irrecoverable hydraulic losses.

53. The nozzle block of claim 50 wherein the upstream nozzle has a surface having a trapezoidal cross section.

54. The nozzle block of claim 50 wherein the upstream nozzle defines an upstream nozzle inlet end and a an upstream nozzle discharge end with an upstream nozzle axis of discharge substantially perpendicular to the longitudinal axis of the nozzle block, the cleaning medium entering the hollow interior of the nozzle block body through the proximate end and exiting the nozzle block through the downstream nozzle and the upstream nozzle.

55. The nozzle block of claim 50 the inlet end of the downstream nozzle is in communication with the hollow interior of the nozzle block body.

56. The nozzle block of claim 50 wherein the nozzle block hollow interior defines a converging channel of decreasing cross section between the upstream nozzle and the downstream nozzle for directing the flow of the cleaning medium past the upstream nozzle to the inlet end of the downstream nozzle.

57. The nozzle block of claim 56 wherein the converging channel is defined at least in part by a contoured body disposed adjacent the downstream nozzle and contacting the hollow interior of the nozzle block body.

58. The nozzle block of claim 56 wherein the contoured body defines a tip which in part defines the inlet end of the downstream nozzle.

59. The nozzle block of claim 50 wherein the upstream nozzle and the airfoil body are formed of an integral piece.

60. The nozzle block of claim 50 wherein the nozzle block body and the downstream nozzle cooperating such that the flow of the cleaning medium flowing in the direction of the longitudinal axis from the proximate end to the distal end through the nozzle block body interior does not flow substantially beyond the downstream nozzle inlet end.

61. The nozzle block of claim 50 wherein the flow of cleaning medium in the direction of the longitudinal axis is assumed positive from the proximate end to the distal end and once the cleaning medium enters the downstream nozzle inlet, there is an absence of the flow of the cleaning medium in the negative direction.

62. The nozzle block of claim 50 wherein the downstream nozzle axis of discharge defines an axis (Z) and wherein once the flow of the cleaning medium reaches the inlet end of the downstream nozzle, there is an absence of any cleaning medium flow component in the negative Z direction.

63. The nozzle block of claim 50 wherein the cleaning medium is comprised at least in part of steam.

64. The nozzle block of claim 50 adapted to be connected with a lance tube, the nozzle block and the lance tube having a cylindrical exterior surface with both the downstream nozzle and the upstream nozzle located within the cylindrical surface.

* * * * *